US008122919B2

(12) United States Patent
Park

(10) Patent No.: US 8,122,919 B2
(45) Date of Patent: Feb. 28, 2012

(54) DUAL FLUID LNG TRANSFERRING ARM

(75) Inventor: Jae-Wook Park, Seoul (KR)

(73) Assignee: Mi-Young Kim, Seoul (KR), part interest ( * ) Notice: Subject to any disclaimer, the term of this patent is extended or adjusted under 35 U.S.C. 154(b) by 894 days.

(21) Appl. No.: 11/994,105

(22) PCT Filed: Jun. 5, 2006

(86) PCT No.: PCT/KR2006/002166

§ 371 (c)(1),
(2), (4) Date: Jul. 14, 2008

(87) PCT Pub. No.: WO2007/001125

PCT Pub. Date: Jan. 4, 2007

(65) Prior Publication Data

US 2008/0289721 A1 Nov. 27, 2008

(30) Foreign Application Priority Data

Jun. 28, 2005 (KR) ..... 10-2005-0056420

(51) Int. Cl.
*B67D 9/02* (2010.01)

(52) U.S. Cl. ..... 141/279; 141/382; 441/5; 62/50.7; 62/53.2; 137/615

(58) Field of Classification Search ..... 141/279, 141/382, 383, 387; 137/615; 62/50.1, 50.7, 62/53.2; 441/4–5
See application file for complete search history.

(56) References Cited

U.S. PATENT DOCUMENTS

| | | | | | |
|---|---|---|---|---|---|
| 4,050,585 | A * | 9/1977 | Wilms | 137/615 |
| 4,099,542 | A | 7/1978 | Gibbons | |
| 4,121,616 | A * | 10/1978 | Lochte et al. | 137/615 |
| 4,142,551 | A | 3/1979 | Wilms | |
| 4,276,917 | A * | 7/1981 | Fujita | 141/387 |
| 4,290,463 | A | 9/1981 | DeGeorge et al. | |
| 4,341,242 | A * | 7/1982 | Hermanson | 137/615 |
| 4,388,948 | A * | 6/1983 | Carminati et al. | 137/615 |
| 4,393,906 | A * | 7/1983 | Gill | 141/387 |
| 4,867,211 | A | 9/1989 | Dodge et al. | |
| 6,434,948 | B1 * | 8/2002 | Eide et al. | 62/50.1 |

(Continued)

FOREIGN PATENT DOCUMENTS

JP 09278190 10/1997

*Primary Examiner* — Gregory Huson
*Assistant Examiner* — Nicolas A Arnett
(74) *Attorney, Agent, or Firm* — McDermott Will & Emery LLP

(57) ABSTRACT

Disclosed herein is an LNG transferring arm. The LNG transferring arm includes a cylindrical support base. A main body is rotatably provided on the support base. A boom assembly is connected to a side of the main body to rotate up and down. A support assembly supports the boom assembly and is bent along with the boom assembly. A transfer pipe and a return pipe are arranged along the boom assembly. An end of each of the transfer pipe and the return pipe is connected to a tank to which LNG will be transferred. A balance weight is rotatably supported above the main body via a bracket, and is hinged at one end thereof to the boom assembly, thus maintaining balance. A rotary branch means is provided in the main body, and includes two pipes having different diameters and arranged concentrically.

7 Claims, 6 Drawing Sheets

U.S. PATENT DOCUMENTS 6,851,994 B2 * 2/2005 Boatman et al. ..... 441/4
6,923,225 B2 * 8/2005 Poldervaart et al. ..... 141/387
6,994,506 B2 * 2/2006 de Baan ..... 141/388
7,066,219 B2 * 6/2006 Poldervaart et al. ..... 141/387
7,610,934 B2 * 11/2009 Naciri et al. ..... 137/615
7,810,520 B2 * 10/2010 Perratone et al. ..... 137/615

* cited by examiner

[Fig. 3]
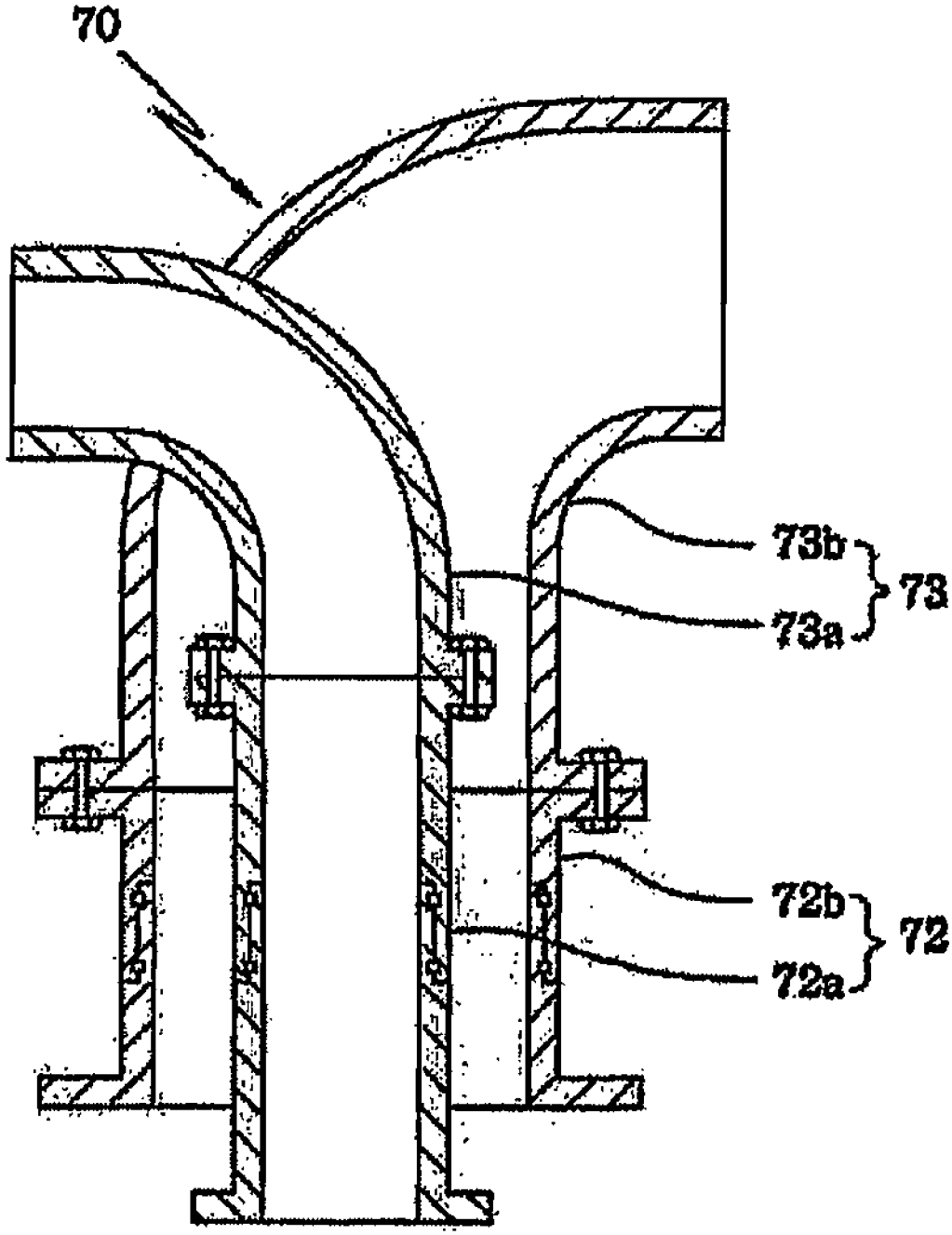

[Fig. 4]
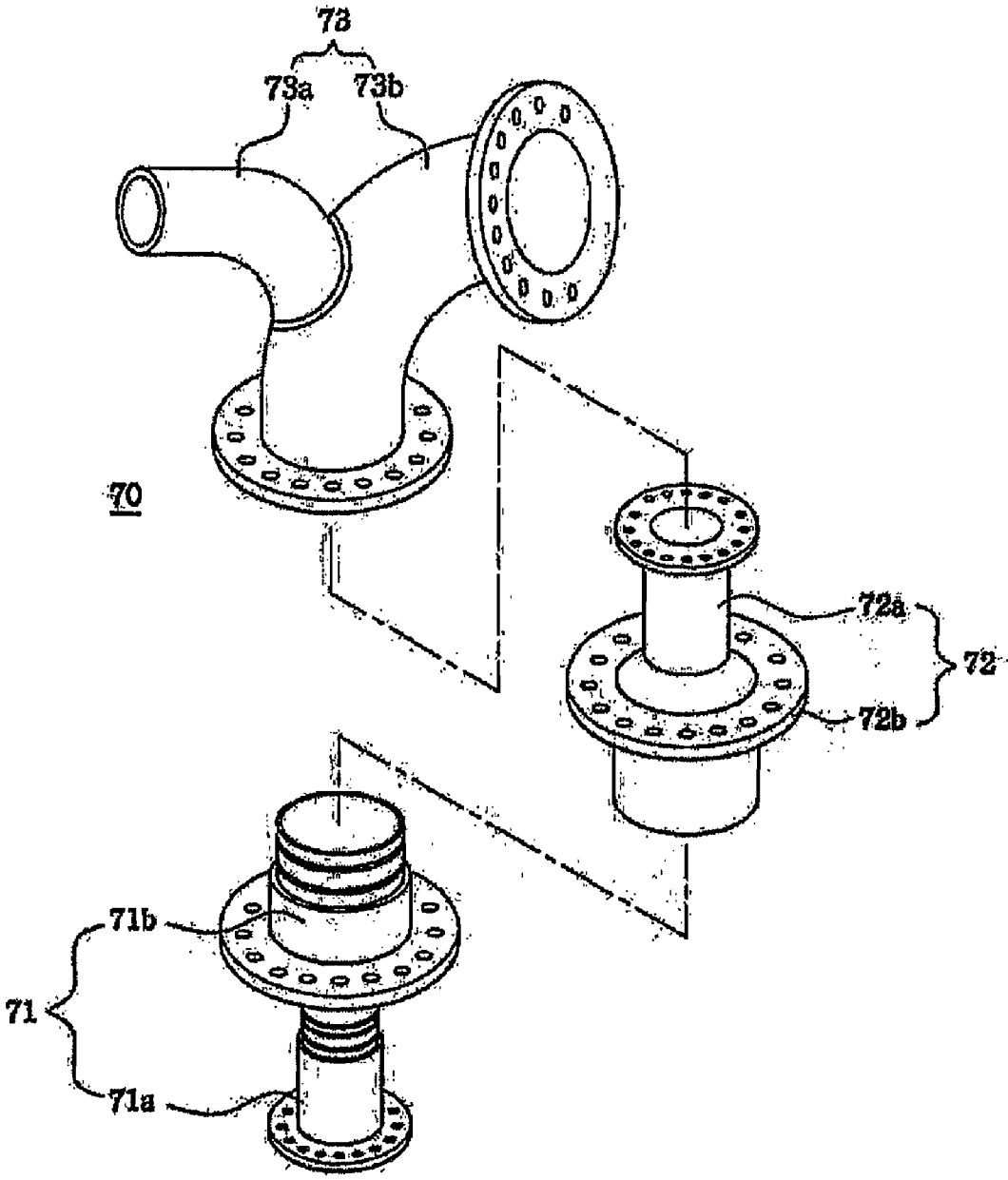

DUAL FLUID LNG TRANSFERRING ARM

CROSS REFERENCE TO PRIOR APPLICATIONS

This application is the U.S. national phase of International Application No. PCT/KR2006/002166, filed Jun. 5, 2006, which claims priority from Korean Patent Application No. 10-2005-0056420, filed Jun. 28, 2005, the disclosure of both are incorporated herein by reference in their entirety. The International Application was published in English on Jan. 4, 2007 as WO 2007/001125 under PCT Article 21(2).

TECHNICAL FIELD

The present invention relates to an LNG loading arm, which is constructed so that an articulation is rotatable and bendable, thus safely transferring liquefied gas between floating objects.

BACKGROUND ART

Generally, a loading arm is a device which is used to transfer liquid freight, including crude oil and liquefied natural gas (LNG), from a transport vessel to storage equipment which is installed on land. The loading arm is a kind of coupling device for coupling the transport vessel to a quay wall, and has a coupling structure having articulations to compensate for variation in the depth of water when the vessel is moored and freight is transshipped. Further, several loading arms are simultaneously coupled to the side of a vessel to load and unload the vessel.

Meanwhile, when LNG is loaded or unloaded, an additional gas loading arm is connected to be parallel to the LNG loading arm, thus helping carry boil-off gas.

The transshipment and transfer of liquid freight between objects floating at sea are performed as follows. That is, a fender is inserted between the floating objects, and the floating objects are coupled to each other using a hose, thus transferring fluid between the floating objects. However, when waves rise, the floating objects may be damaged due to a collision therebetween, and thus may cause a fire. Therefore, actually, it is difficult to transfer liquid freight between the floating objects.

In order to solve the problem, the following method of transferring crude oil was devised. That is, floating objects, such as vessels, are arranged at regular intervals in a longitudinal direction, and are connected to each other using rope. Subsequently, in order to prevent collisions between the floating objects, a suitable amount of driving force is applied in opposite directions. In such a state, hoses couple bows to sterns. Such a method is used to transship freight between Floating Production, Storage and Offloading (FPSO) installations and transport vessels.

However, the method is problematic in that, when more than one hose is used, the hoses may become tangled. Further, the hose usually sags and soaks in seawater, so that low-temperature liquefied gas, such as cryogenic LNG, is vaporized in the transfer hose by seawater, which has a high specific heat, and thus the low-temperature liquefied gas cannot be used. Meanwhile, when one desires to transfer LNG, boil-off gas must be simultaneously returned. Thus, the above-mentioned method is not suitable for an LNG transfer operation, which requires two hoses.

DISCLOSURE OF INVENTION

Technical Problem

Accordingly, the present invention has been made keeping in mind the above problems occurring in the prior art, and an object of the present invention is to provide an LNG loading arm, which compensates for the movement of two floating objects due to wind and irregular waves on the sea, and allows LNG to be stably transferred.

Technical Solution

In order to accomplish the object, the present invention provides a LNG transferring arm, including a cylindrical support base mounted to a side of a hull; a main body comprising a rotating structure which is rotatably provided on an upper portion of the support base; a boom assembly comprising a longitudinal member which is connected to a side of the main body in such a way as to rotate up and down, and which is bendable at one end thereof; a support assembly supporting the boom assembly, the support assembly being bent along with the boom assembly, being assembled by a plurality of articulation links, and being bent by a cylinder; a transfer pipe and a return pipe arranged along the boom assembly, and each having a rotary articulation, an end of each of the transfer pipe and the return pipe being connected to a tank to which liquefied matter will be transferred; a balance weight rotatably supported above the main body via a bracket, and hinged at one end thereof to the boom assembly, thus maintaining balance; and a rotary branch means provided in the main body, and comprising two pipes which have different diameters and are arranged concentrically, a lower portion of the rotary branch means being fixedly connected to a gas storage tank and an upper portion of the rotary branch means being rotatably branched to be connected to the transfer pipe and the return pipe.

According to an aspect of this invention, the rotary branch means includes a dual supporting concentric pipe comprising a first pipe having a small diameter and a second pipe having a large diameter, one end of the dual supporting concentric pipe being connected to the gas storage tank; a dual rotating concentric pipe rotatably coupled to an upper portion of the dual supporting concentric pipe via a bearing, and comprising a third pipe and a fourth pipe which have the same diameters as the first pipe and the second pipe; and a dual branch pipe integrally coupled to an upper portion of the dual rotating concentric pipe, and having a fifth pipe and a sixth pipe which are concentrically connected to the third pipe and the fourth pipe, one end of the fifth pipe with a small diameter passing through one end of the sixth pipe with a large diameter to extend to an outside.

According to another aspect of this invention, each of the transfer pipe and the return pipe is provided with extension pipes which are extendable to a predetermined distance.

According to a further aspect of this invention, the support assembly includes a main support arranged to be parallel to and spaced apart from the main boom, and a subsidiary support arranged along the subsidiary boom. The main support is connected at a first end thereof to the bracket which is secured to the main body, using the articulation links, and has at a second end thereof a rod which is slidably mounted to the main support in such a way as to extend, with an end of the rod being hinged to the subsidiary support.

Further, the boom assembly includes a main boom comprising the longitudinal member which is connected at a first end thereof to the rotating structure, and a subsidiary boom hinged to a second end of the main boom.

Furthermore, the subsidiary boom comprises two or more subsidiary booms, and the transfer pipe and the return pipe are hinged to be integrated with the subsidiary boom.

The above and other objects, features and advantages of the present invention will be more clearly understood from the following detailed description taken in conjunction with the accompanying drawings. The terms or words used in the specification and claims have been selected to most easily describe the invention, and may be changed without departing from the spirit and scope of the invention.

ADVANTAGEOUS EFFECTS

An LNG transferring arm, constructed and operated as described above, compensates for variation in position between vessels (floating objects) caused by wind and irregular waves, thus stably transferring LNG, therefore providing various courses of transferring LNG.

BRIEF DESCRIPTION OF THE DRAWINGS

FIG. 3 is a sectional view showing a rotary branch means, according to the present invention;

FIG. 4 is an exploded perspective view illustrating the construction of the rotary branch means, according to the present invention.

DESCRIPTION OF REFERENCE CHARACTERS OF IMPORTANT PARTS

Figure 1:
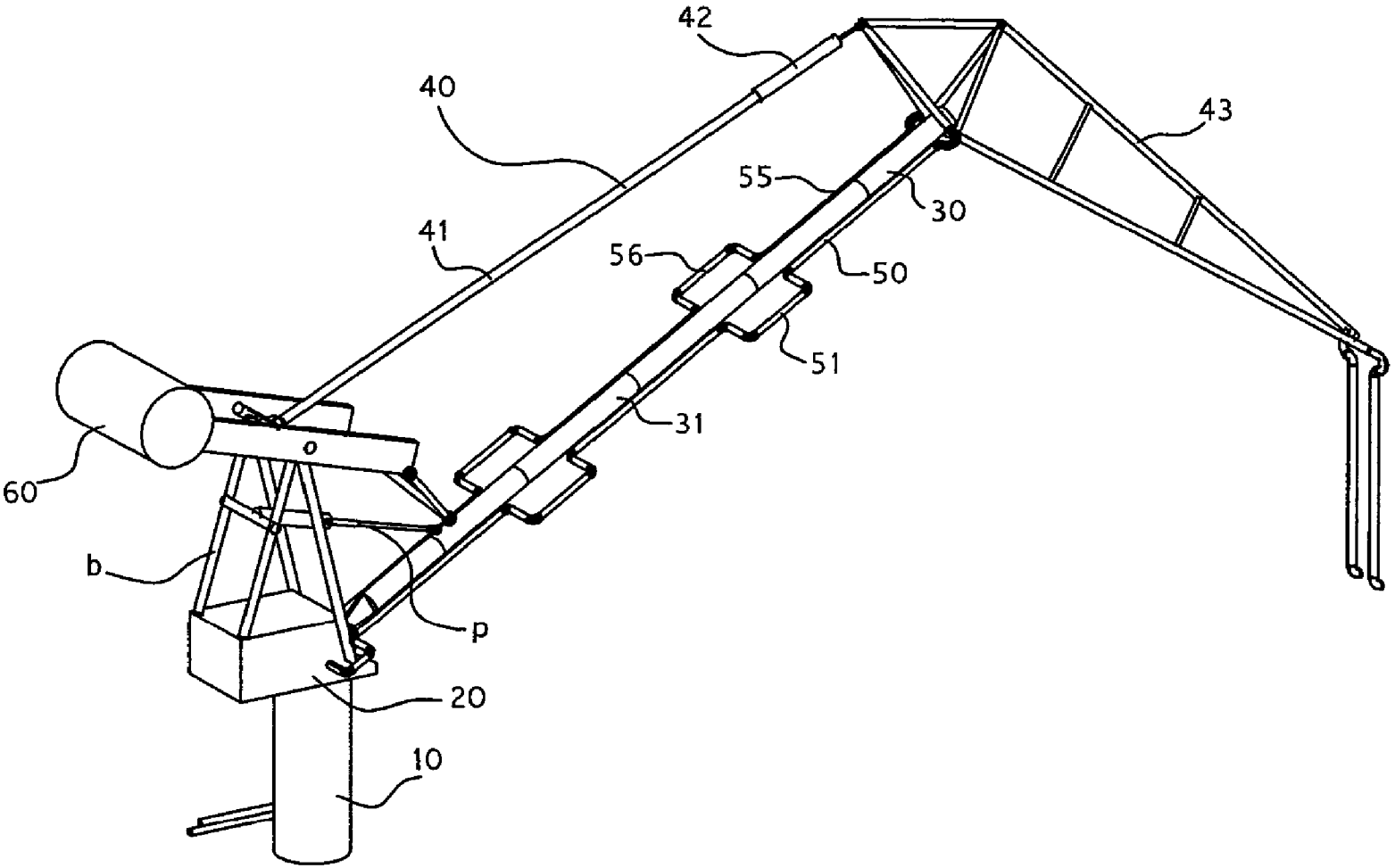
FIG. 1 is a perspective view showing an LNG transferring arm, according to the present invention.

10: support base 20: main body
30: boom assembly 31: main boom
32: subsidiary boom 40: support assembly
41: main support 43: subsidiary support
50: transfer pipe 51: extension pipe
55: return pipe 56: extension pipe
60: balance weight 70: rotary branch means
b: bracket p: cylinder

BEST MODE FOR CARRYING OUT THE INVENTION

The present invention provides an LNG transferring arm. More particularly, the present invention provides an LNG transferring arm, in which an articulation rotates and bends in conjunction with the movement of floating objects due to wind and irregular waves on the sea, thus enabling safe transfer of LNG between the floating objects.

MODE FOR THE INVENTION

Hereinafter, an LNG loading arm according to the preferred embodiment of the present invention will be described with reference to the accompanying drawings.

Figure 2A:
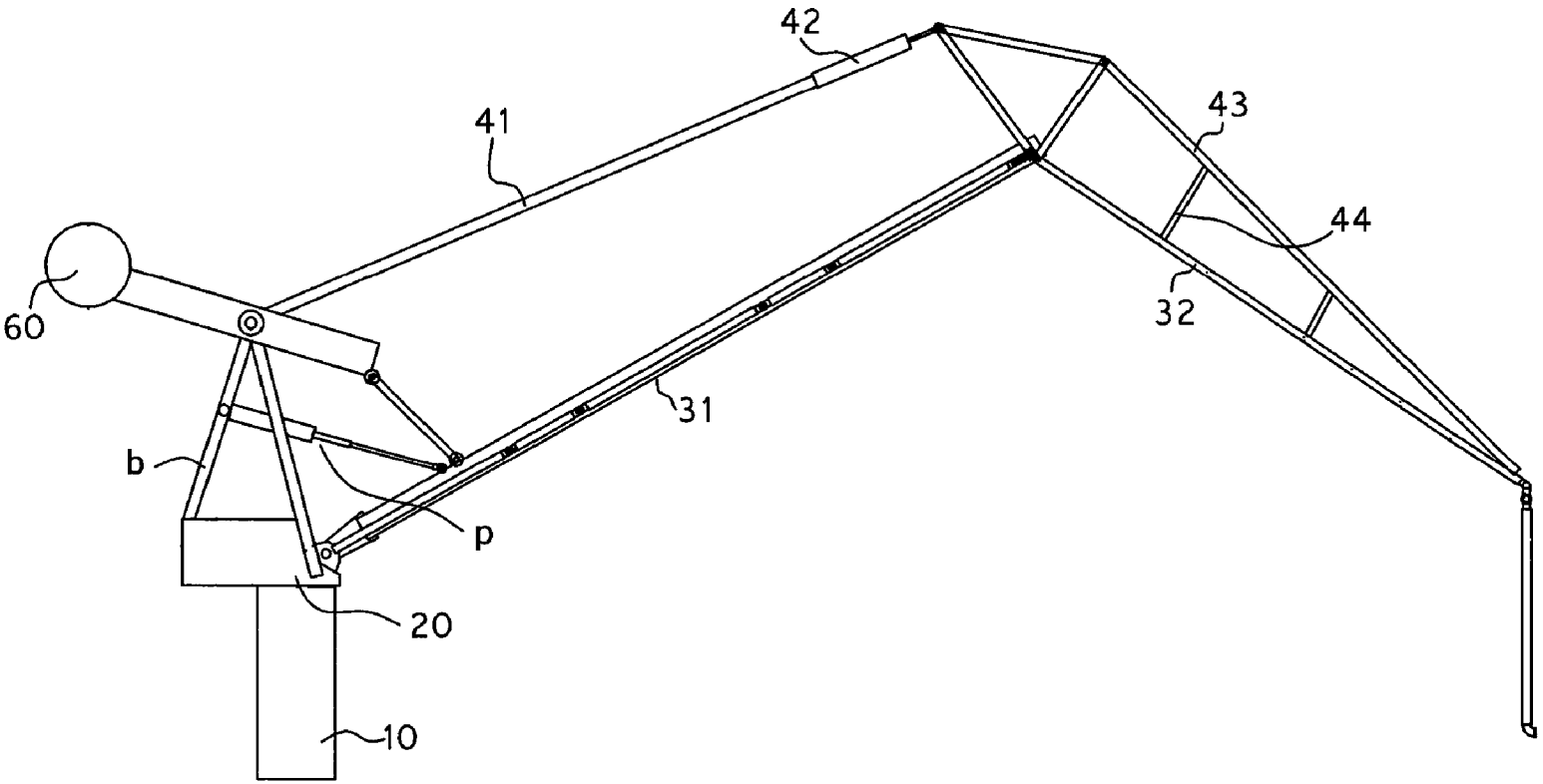
FIG. 2A is a side view schematically showing the structure of the LNG transferring arm, according to the present invention.
Figure 2B:
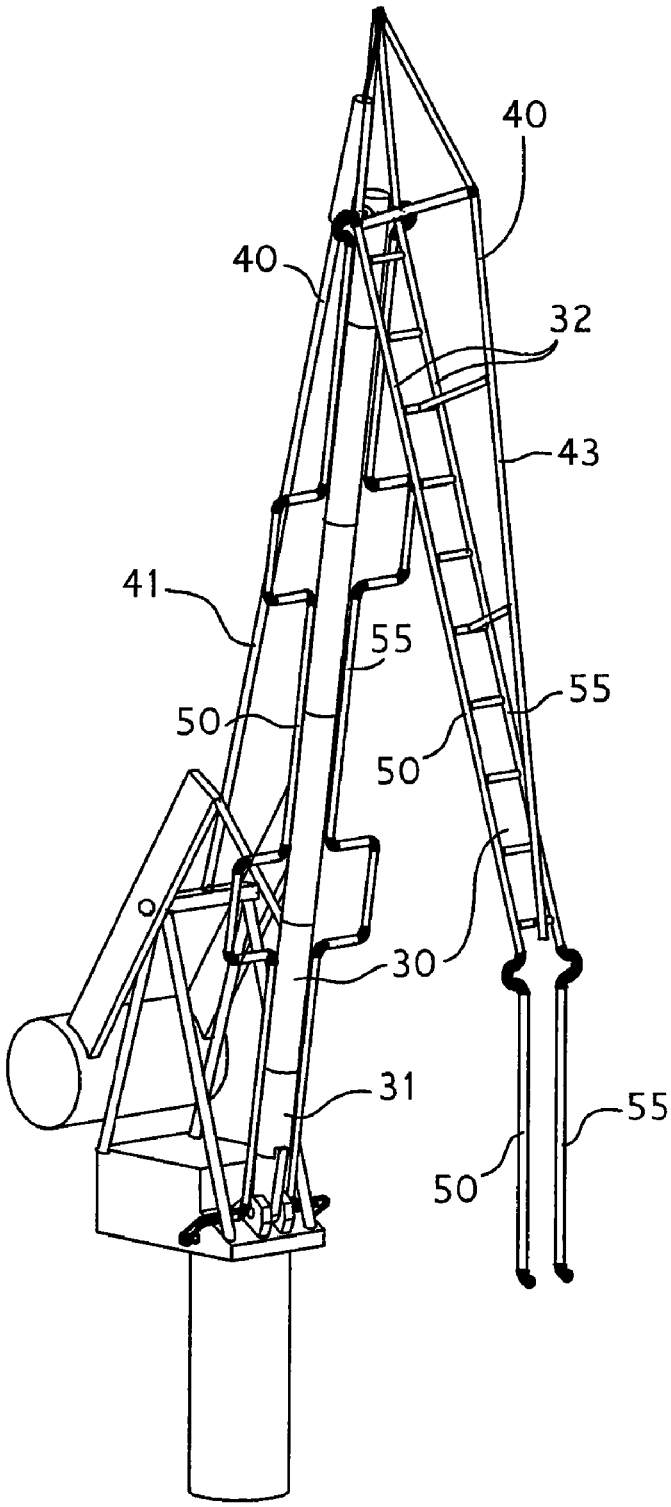
FIG. 2B is a front, right perspective view schematically showing the structure of the LNG transferring arm, according to the present invention.
Figure 5:
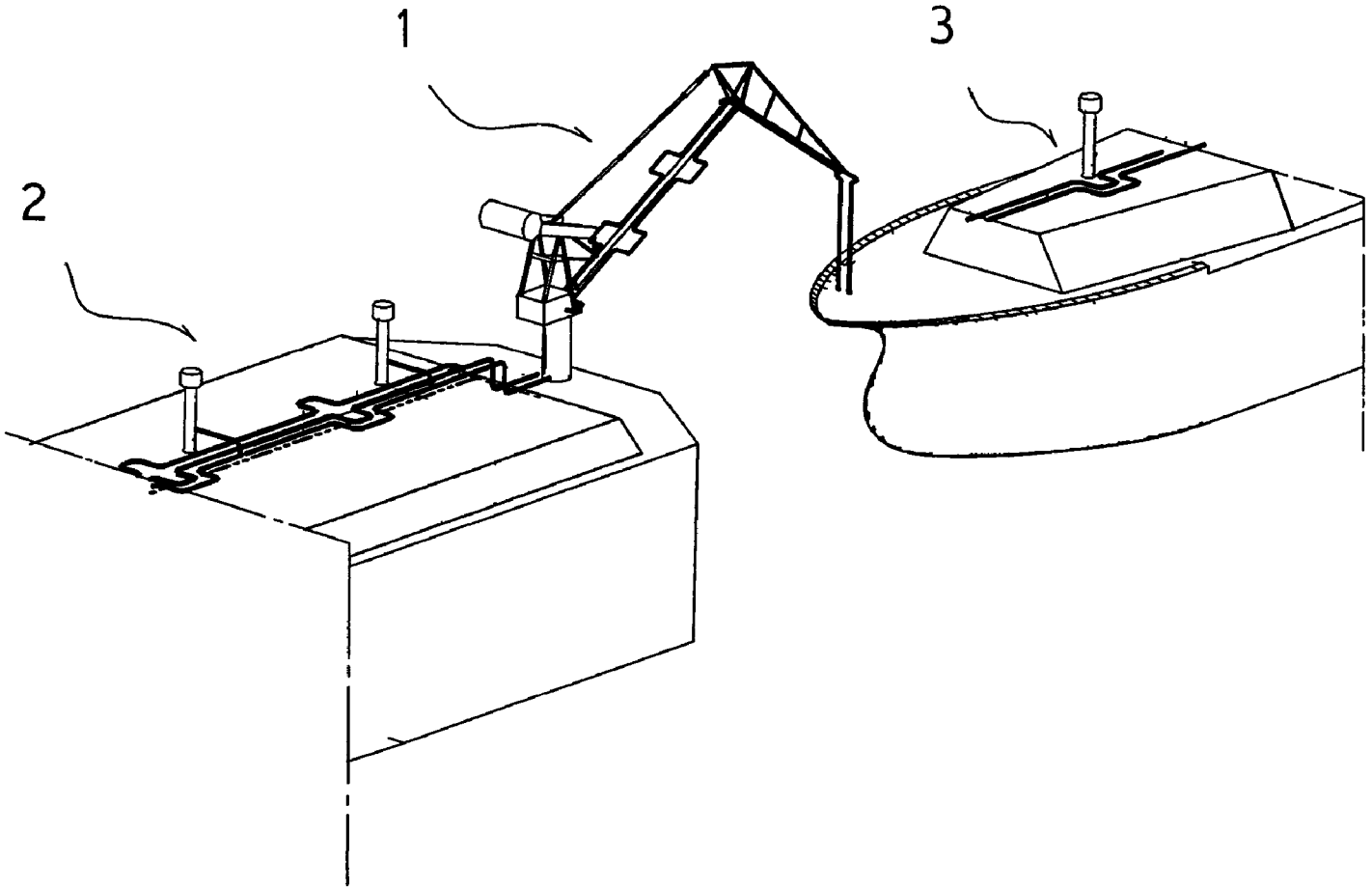
FIG. 5 is a view illustrating the use of the LNG transferring arm, according to the present invention.

FIG. 1 is a perspective view showing an LNG transferring arm, according to the present invention, and FIG. 2 is a side view schematically showing the structure of the LNG loading arm, according to the present invention. Further, FIG. 3 is a sectional view showing a rotary branch means, according to the present invention, FIG. 4 is an exploded perspective view illustrating the construction of the rotary branch means, according to the present invention, and FIG. 5 is a view illustrating the use of the LNG transferring arm, according to the present invention.

As shown in the drawings, the LNG transferring arm 1 according to the present invention transfers LNG and boil-off gas between two floating objects which are freely movable on the sea such that the LNG and the boil-off gas are exchanged with each other, and appropriately compensates for irregular variation in position between the floating objects due to wind and waves, thus stably transferring liquid freight.

The LNG transferring arm 1 having these characteristics includes a support base 10, a main body 20, a boom assembly 30, a support assembly 40, a transfer pipe 50, a return pipe 55, a balance weight 60, and a rotary branch means 70. The support base 10 is mounted to the side of a hull of a vessel or the like. The main body 20 is rotatably mounted to the upper portion of the support base 10. The boom assembly 30 is provided on the main body 20 in such a way as to rotate once. The support assembly 40 functions to support the boom assembly 30. The transfer pipe 50 and the return pipe 55 function to transfer LNG and boil-off gas, respectively. The balance weight 60 controls the positions of the boom assembly 30 and the support assembly 40. The rotary branch means 70 is integrated with the main body 20 to rotate the transfer pipe 50 and the return pipe 55.

The support base 10 is a cylindrical support structure which is mounted to the side of the hull, and the rotary branch means 70 is provided in the support base 10. Such a support base 10 functions to support the boom assembly 30, the support assembly 40, the balance weight 60, the transfer pipe 50, and the return pipe 55 at a position spaced apart from the bottom of the hull by a predetermined height. Part of the rotary branch means 70 is positioned in the support base 10.

The tubular main body 20 is rotatably provided on the upper portion of the support base 10 constructed as described above. The main body 20 is rotatably mounted to the upper portion of the support base 10, and is freely rotated, either manually or automatically. In this case, the rotating structure of the main body 20 may make use of a known art. For example, in the case where the main body 20 is rotated manually, the main body 20 and the support base 10 are coupled to each other using a bearing. Conversely, in the case where the main body 20 is rotated automatically, it is rotated using power produced from a motor or an engine.

The boom assembly 30 and the support assembly 40 are coupled to the side of the main body 20, constructed as described above. The boom assembly 30 is constructed by coupling booms, each having a predetermined length, in multiple stages. One end of the boom assembly 30 is coupled to the side of the main body 20 in such a way as to rotate up and down. That is, the boom assembly 30 is provided with a main boom 31 which has a predetermined length and is rotatably hinged at one end thereof to the side of the main body 20 which is the rotating structure. A subsidiary boom 32 is hinged to the other end of the main boom 31. Thereby, the boom assembly 30 is selectively bendable. As seen in the drawing, the main boom 31 is placed such that an end of the main boom 31 faces upwards, and the subsidiary boom 32 is placed such that an end of the subsidiary boom 32 faces downwards.

The boom assembly 30 constructed as such is firmly supported by the support assembly 40. The support assembly 40 stably supports the boom assembly 30, and is bendable together with the boom assembly 30 to be operated in conjunction with the boom assembly 30. The support assembly 40 is assembled using a plurality of articulation links, and is bendable by the operation of a cylinder p having an actuating rod which extends or retracts.

That is, the support assembly 40 includes a main support 41 and a subsidiary support 43 which have predetermined lengths and are hinged to each other. In this case, the main support 41 and the main boom 31 are arranged to be parallel to each other while being spaced apart from each other. A rod 42 is slidably mounted to an end of the main support 41 in such a way as to be extended. The main support 41 is connected at opposite ends thereof to a bracket and the subsidiary support using links provided on opposite ends of the main boom 31. Further, one end of the subsidiary support 43 is hinged to the main support 41, and the other end of the subsidiary support 43 is secured to the other end of the subsidiary boom 32. The subsidiary support 43 is connected to the subsidiary boom 32 using a plurality of links 44.

That is, the main support 41 is connected to the main boom 31 using the links so as to have a rectangular shape. Consequently, the position of the main support 41 may be changed in the longitudinal direction of the main boom 31. The subsidiary support 43 is hinged to the main support 41, and is connected at an end thereof to an end of the subsidiary boom 32, thus bending the end of the subsidiary boom 32 up and down.

Meanwhile, the cylinder p is connected at one end thereof to the bracket b, and the actuating rod provided on the other end of the cylinder is hinged at one end thereof to the boom assembly 30. Such a construction allows the cylinder p to move up and down the boom assembly 30 which is directly connected to the cylinder by extending or retracting the actuating rod, and allows the support assembly 40 to be operated in conjunction with the boom assembly 30.

The support assembly 40 constructed as described above, and illustrated in FIG. 2B, is a kind of reinforcing structure for firmly and stably supporting the boom assembly 30, the transfer pipe 50 and the return pipe 55, which will be described below in detail. Thus, the support assembly 40 may be appropriately changed according to the size or shape of the boom assembly 30, the transfer pipe 50, and the return pipe 55.

The transfer pipe 50 and the return pipe 55 are pipes for passing LNG and boil-off gas, respectively. In order to allow the transfer pipe 50 and the return pipe 55 to be operated in conjunction with the boom assembly 30, rotary articulations are provided at the position where the boom assembly 30 bends. Further, extension pipes 51, 56 are provided at a plurality of places to compensate for the expansion and contraction of the pipes when LNG and boil-off gas pass through the pipes.

In this case, each rotary articulation may be embodied by a general rotary-pipe coupling structure which rotatably couples two pipes to each other. Further, the extension pipes 51 and 56 may be embodied by a known extension pipe structure, the length of which can be variably increased or reduced. Thus, a detailed description of the structures will be omitted.

An end of the transfer pipe 50 and an end of the return pipe 55 are connected to a tank of a vessel to which LNG will be transferred, so that LNG is fed through the transfer pipe 50, and boil-off gas charged in the tank is returned through the return pipe 55.

The balance weight 60 is rotatably provided above the main body 20 through the bracket b, and is hinged at one end thereof to the boom assembly 30 so that the balance weight 60 keeps the balance. As shown in the drawings, the balance weight 60 changes the rotating angle, thus moving the center of gravity of the structure comprising the boom assembly 30 and the support assembly 40, therefore controlling the balance, that is, the position of the loading arm.

The rotary branch means 70 is provided in the support base 10 and the main body 20, and includes two pipes which have different diameters and are arranged concentrically. The lower portions of the pipes are fixedly connected to a gas storage tank, while the upper portions of the pipes are rotatable and branched to be connected to the transfer pipe 50 and the return pipe 55, respectively. That is, the rotary branch means 70 includes a dual supporting concentric pipe 71, a dual rotating concentric pipe 72, and a dual branch pipe 73. The dual supporting concentric pipe 71 includes a first pipe 71*a* having a small diameter and a second pipe 71*b* having a large diameter. The first pipe 71*a* and the second pipe 71*b* are concentrically arranged, and are connected at one end to the gas storage tank. The dual rotating concentric pipe 72 is rotatably coupled to the upper portion of the dual supporting concentric pipe 71 via a bearing, and includes third and fourth pipes 72*a* and 72*b* which have the same diameters as the first and second pipes 71*a* and 71*b* and are connected to the first and second pipes 71*a* and 71*b*. The dual branch pipe 73 is integrally coupled to the upper portion of the dual rotating concentric pipe 72, and is provided with fifth and sixth pipes 73*a* and 73*b* which are concentrically connected to the third and fourth pipes 72*a* and 72*b*. One end of the fifth pipe 73*a* having a small diameter passes through the side of the sixth pipe 73*b*, having a large diameter, to extend to the outside, so that the dual branch pipe 73 branches into the fifth pipe and the sixth pipe. In this case, the branching point of the dual branch pipe 73 is welded to maintain air-tightness.

The rotary branch means 70 is constructed so that the dual supporting concentric pipe 71 is fixed, and the dual rotating concentric pipe 72 and the dual branch pipe 73, provided above the dual supporting concentric pipe 71, rotate along with the main body 20.

The operation of the LNG transferring arm of the present invention constructed as described above will be described below.

First, first and second floating objects 2 and 3, such as vessels which freely move on the sea, are arranged. The LNG transferring arm 1 is mounted to one side of the first floating object 2, on which the gas storage tank (not shown) storing LNG therein is mounted.

Next, the first floating object 2 having the gas storage tank and the second floating object 3 having a tank (not shown) to which LNG will be transferred are positioned to maintain a safe distance therebetween. In such a state, the transferring operation is performed using the LNG transferring arm. That is, one end of each of the transfer pipe 50 and the return pipe 55, supported by the boom assembly 30 and the support assembly 40, which are bendable and rotatable, is connected to the LNG storage tank of the first floating object, and an opposite end of each of the transfer pipe 50 and the return pipe 55 are connected to the second floating object, to which LNG will be transferred. In such a state, LNG stored in the storage tank of the first floating object is transferred through the transfer pipe 50 to the tank of the second floating object. Simultaneously, boil-off gas filled in the tank of the second floating object is returned through the return pipe 55.

In this case, the transfer pipe 50 and the return pipe 55 are operated integrally when the boom assembly 30 and the support assembly 40 are bent. Thus, even when the positions of the first and second floating objects are changed by waves or wind, the variation in position is compensated for, and thus a stable transferring operation is realized. Particularly, each of the transfer pipe 50 and the return pipe 55 is integrated with the 'U'-shaped extension pipes 51, 56, thus compensating for extension or contraction of the pipes when cryogenic LNG is transferred. Further, the transfer pipe 50 and the return pipe 55 are combined into one concentric pipe by the rotary branch means 70 in the main body 20, which is the rotating structure. Thereby, the transfer pipe 50 and the return pipe 55 are integrally rotated in conjunction with the main body 20.

Thus, the bending or rotating action of the LNG transferring arm including the main body 20, the boom assembly 30, the support assembly 40, the transfer pipe 50, and the return pipe 55 compensates for irregular variation in the position of two floating objects coupled via rope on the open sea, thus enabling safe performance of the operation of transferring LNG and the operation of returning boil-off gas.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

As described above, the present invention provides an LNG transferring arm, which compensates for variation in position of vessels (floating objects) due to wind and irregular waves, thus stably transferring LNG, therefore providing various courses of transferring LNG.

The invention claimed is:

1. A LNG transferring arm, comprising:

a cylindrical support base mounted to a side of a hull;

a main body comprising a rotating structure which is rotatably provided on an upper portion of the support base;

a boom assembly comprising a longitudinal member which is connected to a side of the main body in such a way as to rotate up and down, and which is bendable at one end thereof;

a support assembly supporting the boom assembly, the support assembly being bent along with the boom assembly, being assembled by a plurality of articulation links, and being bent by a cylinder; a transfer pipe and a return pipe arranged along the boom assembly, and each having a rotary articulation, an end of each of the transfer pipe and the return pipe being connected to a tank to which LNG will be transferred;

a balance weight rotatably supported above the main body via a bracket, and hinged at one end thereof to the boom assembly, thus maintaining balance; and rotary branch means provided in the main body, and comprising two pipes which have different diameters and are arranged concentrically, a lower portion of the rotary branch means being fixedly connected to a gas storage tank and an upper portion of the rotary branch means being rotatably branched to be connected to the transfer pipe and the return pipe.

2. The LNG transferring arm according to claim 1, wherein the boom assembly comprises:

a main boom comprising the longitudinal member which is connected at a first end thereof to the rotating structure; and a subsidiary boom hinged to a second end of the main boom.

3. The LNG transferring arm according to claim 2, wherein the subsidiary boom comprises two or more subsidiary booms, and the transfer pipe and the return pipe are hinged to be integrated with the subsidiary boom.

4. The LNG transferring arm according to claim 2, wherein the support assembly comprises:

a main support arranged to be parallel to and spaced apart from the main boom; and a subsidiary support arranged along the subsidiary boom, the main support being connected at a first end thereof to the bracket which is secured to the main body, using the articulation links, and having at a second end thereof a rod which is slidably mounted to the main support in such a way as to extend, with an end of the rod being hinged to the subsidiary support.

5. The LNG transferring arm according to claim 1, wherein the rotary branch means comprises:

a dual supporting concentric pipe comprising a first pipe having a small diameter and a second pipe having a large diameter, one end of the dual supporting concentric pipe being connected to the gas storage tank;

a dual rotating concentric pipe rotatably coupled to an upper portion of the dual supporting concentric pipe via a bearing, and comprising a third pipe and a fourth pipe which have the same diameters as the first pipe and the second pipe; and a dual branch pipe integrally coupled to an upper portion of the dual rotating concentric pipe, and having a fifth pipe and a sixth pipe which are concentrically connected to the third pipe and the fourth pipe, one end of the fifth pipe with a small diameter passing through one end of the sixth pipe with a large diameter to extend to an outside.

6. The LNG transferring arm according to claim 1, wherein each of the transfer pipe and the return pipe is provided with extension pipes which are extendable to a predetermined distance.

7. The LNG transferring arm according to claim 1, wherein the support assembly comprises:

a main support arranged to be parallel to and spaced apart from the main boom; and a subsidiary support arranged along the subsidiary boom, the main support being connected at a first end thereof to the bracket which is secured to the main body, using the articulation links, and having at a second end thereof a rod which is slidably mounted to the main support in such a way as to extend, with an end of the rod being hinged to the subsidiary support.

* * * * *